US010607756B2

(12) United States Patent
Suzuki et al.

(10) Patent No.: US 10,607,756 B2
(45) Date of Patent: Mar. 31, 2020

(54) SOFT MAGNETIC METAL POWDER, SOFT MAGNETIC METAL FIRED BODY, AND COIL TYPE ELECTRONIC DEVICE

(71) Applicant: TDK CORPORATION, Tokyo (JP)

(72) Inventors: Takashi Suzuki, Tokyo (JP); Hidekazu Sato, Tokyo (JP); Yuusuke Nagai, Tokyo (JP); Kouichi Kakuda, Tokyo (JP); Kunihiko Kawasaki, Tokyo (JP); Shinichi Kondo, Tokyo (JP); Yuya Ishima, Tokyo (JP); Shinichi Sato, Tokyo (JP); Masaki Takahashi, Tokyo (JP); Takashi Endo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 277 days.

(21) Appl. No.: 15/618,493

(22) Filed: Jun. 9, 2017

(65) Prior Publication Data

US 2017/0365385 A1 Dec. 21, 2017

(30) Foreign Application Priority Data

Jun. 15, 2016 (JP) ..... 2016-118951

(51) Int. Cl.

| | |
|---|---|
| ***H01F 1/147*** | (2006.01) |
| ***H01F 17/00*** | (2006.01) |
| ***H01F 17/04*** | (2006.01) |
| ***H01F 27/255*** | (2006.01) |
| ***H01F 27/28*** | (2006.01) |

(52) U.S. Cl.

CPC ..... *H01F 1/14766* (2013.01); *H01F 17/0013* (2013.01); *H01F 17/04* (2013.01); *H01F 27/255* (2013.01); *H01F 27/2804* (2013.01); *H01F 2017/048* (2013.01); *H01F 2027/2809* (2013.01)

(58) Field of Classification Search

None

See application file for complete search history.

(56) References Cited

U.S. PATENT DOCUMENTS

| | | | | |
|---|---|---|---|---|
| 7,871,474 | B2 | 1/2011 | Unoki et al. | |
| 2007/0196671 | A1* | 8/2007 | Kobayashi ..... | B82Y 25/00 428/447 |
| 2010/0162851 | A1 | 7/2010 | Unoki et al. | |

(Continued)

FOREIGN PATENT DOCUMENTS

| | | |
|---|---|---|
| CN | 101681708 A | 3/2010 |
| CN | 104752014 A | 7/2015 |

(Continued)

OTHER PUBLICATIONS

Abstract Translation of JP 10-335126 A. (Year: 1998).*

(Continued)

*Primary Examiner* — Kevin M Bernatz

(74) *Attorney, Agent, or Firm* — Oliff PLC

(57) ABSTRACT

A soft magnetic metal powder includes a plurality of soft magnetic metal grains composed of an Fe—Si based alloy. A content of P in the Fe—Si based alloy is 110 to 650 ppm provided that a total content of Fe and Si is 100 mass %. A soft magnetic metal fired body includes soft magnetic metal fired grains composed of an Fe—Si based alloy. A content of P in the Fe—Si based alloy is 110 to 650 ppm provided that a total content of Fe and Si is 100 mass %.

10 Claims, 2 Drawing Sheets

(56) References Cited

U.S. PATENT DOCUMENTS

| | | | | |
|---|---|---|---|---|
| 2012/0274437 | A1* | 11/2012 | Matsuura | H01F 27/24 336/221 |
| 2014/0049354 | A1* | 2/2014 | Ye | B22F 1/02 336/233 |
| 2015/0187476 | A1 | 7/2015 | Takahashi et al. | |
| 2016/0225503 | A1* | 8/2016 | Taniguchi | H01F 3/08 |
| 2017/0162307 | A1* | 6/2017 | Ishida | H01F 1/26 |
| 2017/0323711 | A1* | 11/2017 | Maezawa | C22C 38/18 |

FOREIGN PATENT DOCUMENTS

| | | | | |
|---|---|---|---|---|
| JP | 10-335126 | A | * | 12/1998 |
| JP | 2000087117 | A | * | 3/2000 |
| JP | 2006-114695 | A | | 4/2006 |
| JP | 2007-012994 | A | | 1/2007 |
| JP | 2008-192897 | A | | 8/2008 |
| JP | 2009-084695 | A | | 4/2009 |
| JP | 2016-012388 | A | | 1/2016 |

OTHER PUBLICATIONS

Machine Translation of JP 10-335126 A. (Year: 1998).*
Abstract Translation of JP 2000-087117 A (Year: 2000).*
Machine Translation of JP 2000-087117 A (Year: 2000).*

* cited by examiner

SOFT MAGNETIC METAL POWDER, SOFT MAGNETIC METAL FIRED BODY, AND COIL TYPE ELECTRONIC DEVICE

BACKGROUND OF THE INVENTION

1. Field of the Invention

The present invention relates to a soft magnetic metal powder, a soft magnetic metal fired body, and a coil type electronic device.

2. Description of the Related Art

Coil type electronic devices, such as transformers, choke coils, and inductors, are known as electronic devices used for power supply circuit of various kinds of electronic apparatus of mobile apparatus or so.

In the coil type electronic devices, a coil (wire) of electric conductor is configured to be arranged around a magnetic body exhibiting predetermined magnetic properties. Various kinds of materials can be used as the magnetic body depending upon desired properties. In multilayer coil type electronic devices, ferrite materials with high permeability and low power loss have been used as the magnetic body.

For corresponding to further downsizing, low power loss, and high frequency of the coil type electronic devices, attempts have been made to use a soft magnetic metal material as a magnetic body whose saturated magnetic flux density is higher than that of the ferrite materials and DC superposition properties are favorable even under a high magnetic field.

Examples of the soft magnetic metal material include pure iron, Fe—Ni alloy, Fe—Si alloy, and Fe—Si—Al alloy. In a power coil application where a large electric current flows, an Fe—Si alloy having a favorable DC superimposition property is suitable as a metal soft magnetic material (for example, Patent Document 1).

When the soft magnetic metal material is used as the magnetic body of the coil type electronic device, insulation property of the soft magnetic metal material is a problem. In particular, when a multilayer coil type electronic device is used, since a magnetic body and a coil conductor of electric conductor are directly in contact with each other, if the magnetic body is composed of a soft magnetic metal material having a low insulation property, a short circuit occurs at the time of application of voltage, and the multilayer coil type electronic device is not established as an electronic device. Thus, even if magnetic properties are favorable, there is a problem of being incapable of using a soft magnetic metal material whose insulation property is low enough to generate short circuit as a magnetic body.

When a soft magnetic metal material having a low insulation property is used as a magnetic core of a choke coil for power supply or so, an eddy current occurs in each soft magnetic metal grain, and loss due to this eddy current becomes large. Thus, the grains constituting the soft magnetic metal powder is provided with an insulation layer to restrain the loss due to eddy current during compression press of a soft magnetic metal powder or before or after this compression press.

However, even if a treatment of providing the soft magnetic metal grains with an insulation layer is carried out, there is the following problem: the loss due to eddy current can be restrained, but the magnetic core still has a low resistivity, and short circuit occurs between terminal electrodes formed in the magnetic core unless an insulation treatment is performed against the surface of the magnetic core.

Patent Document 1: JP 2006-114695 A

SUMMARY OF THE INVENTION

The prevent invention has been achieved under such circumstances. It is an object of the invention to provide an electronic device or so having a magnetic body composed of a soft magnetic metal material capable of achieving both high resistivity and predetermined magnetic properties.

The present inventors have focused on phosphorus (P) of various kinds of impurities contained in a soft magnetic metal material whose main component is iron, and found out that the soft magnetic metal material exhibits a high resistivity by controlling the content of phosphorus within a predetermined range. Then, the present invention has been achieved.

That is, a first aspect of the present invention is:

[1] A soft magnetic metal powder including a plurality of soft magnetic metal grains composed of an Fe—Si based alloy, wherein a content of P in the Fe—Si based alloy is 110 to 650 ppm provided that a total content of Fe and Si is 100 mass %.

When a soft magnetic metal fired body is manufactured using the above soft magnetic metal powder, the fired body can have a high resistivity and further demonstrate predetermined magnetic properties. Thus, the fired body can achieve both high resistivity and predetermined magnetic properties.

[2] The soft magnetic metal powder according to [1], wherein a content of Si is 4.5 to 7.5 mass % provided that a total content of Fe and Si is 100 mass %.

When the ratio of Si in the Fe—Si based alloy is in the above range, the above effects can be further improved.

[3] The soft magnetic metal powder according to [1] or [2] has an average grain size (D50) of 2.0 to 20.0 μm.

When the soft magnetic metal powder has an average grain size in the above range, the above effects can be further improved.

A second aspect of the present invention is:

A soft magnetic metal fired body including soft magnetic metal fired grains composed of an Fe—Si based alloy, wherein a content of P in the Fe—Si based alloy is 110 to 650 ppm provided that a total content of Fe and Si is 100 mass %.

The above soft magnetic metal fired body has a high resistivity and no short circuit in the electronic device and further can demonstrate predetermined magnetic properties. Thus, the fired body can achieve both high resistivity and predetermined magnetic properties.

[5] The soft magnetic metal fired body according to [4], wherein a content of Si is 4.5 to 7.5 mass % provided that a total content of Fe and Si is 100 mass %.

When the ratio of Si in the Fe—Si based alloy is in the above range, the above effects can be further improved.

[6] The soft magnetic metal fired body according to [4] or [5], wherein the soft magnetic metal fired grains have an average grain size (D50) of 2.0 to 20.0 μm.

When the soft magnetic metal fired grains have an average grain size in the above range, the above effects can be further improved.

A third aspect of the present invention is:

A multilayer coil type electronic device including an element where a coil conductor and a magnetic body are laminated, wherein the magnetic body is composed of the soft magnetic metal fired body according to any of [4] to [6].

In a multilayer col type electronic device, a coil conductor of electric conductor and a magnetic body are directly in contact with each other. Thus, when the magnetic body has a low resistivity, short circuit occurs, and the multilayer col type electronic device fails to demonstrate performances as an electronic device at all. On the other hand, the magnetic body is configured by the above soft magnetic metal fired body in the above multilayer coil type electronic device. As a result, the magnetic body has a high resistivity that does not generate short circuit even if the magnetic body is directly in contact with the coil conductor. Thus, no short circuit occurs, and predetermined magnetic properties can be demonstrated in the multilayer coil type electronic device with the magnetic body constituted by the above soft magnetic metal fired body.

A fourth aspect of the present invention is:

[8] A coil type electronic device including a magnetic core, wherein the magnetic core is composed of the soft magnetic metal fired body according to any of [4] to [6].

In the coil type electronic device having the magnetic core, when the magnetic core is constituted by above soft magnetic metal fired body, no short circuit occurs even if no insulation treatment is performed against the surface of the magnetic core.

DESCRIPTION OF THE PREFERRED EMBODIMENTS

Figure 1:
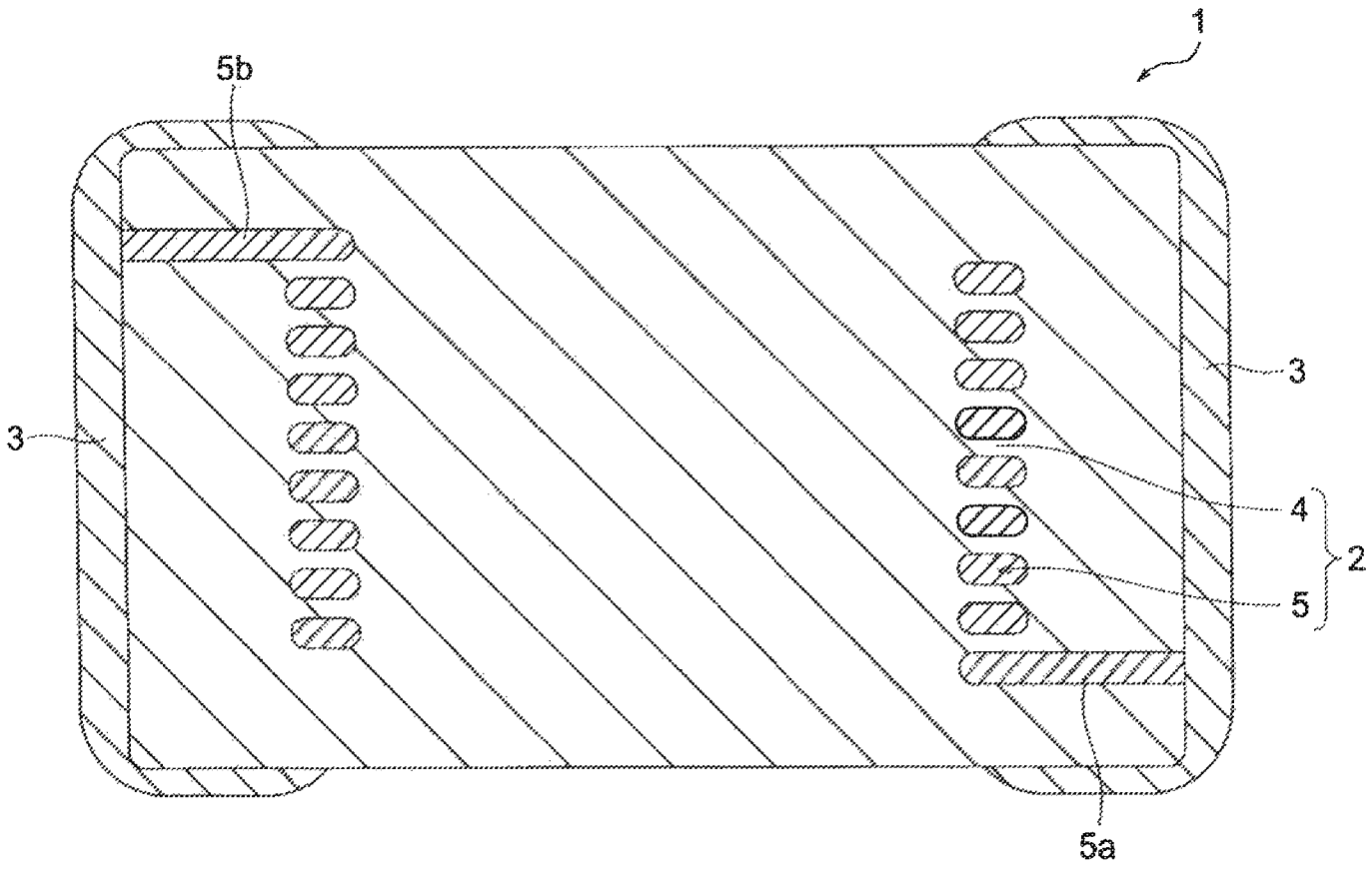
FIG. 1 is a schematic view of a cross section of a multilayer inductor according to an embodiment of the present invention.

Hereinafter, the present invention will be described in detail in the following order based on an embodiment shown in the figures.

1. Soft magnetic metal powder
2. Soft magnetic metal fired body
3. Coil type electronic device
   3.1 Multilayer inductor
   3.1.1 Manufacturing method of multilayer inductor
   3.2 Choke coil
   3.2.1 Manufacturing method of choke coil
4. Effects of present embodiment

1. Soft Magnetic Metal Powder

A soft magnetic metal powder according to the present embodiment is aggregation of a plurality of soft magnetic metal grains. The soft magnetic metal grains are composed of an Fe—Si based alloy. In the present embodiment, a content of other elements including phosphorus mentioned below and excluding oxygen (O) is preferably 0.15 mass % or less at most provided that a total content of Fe and Si is 100 mass % in the Fe—Si based alloy. Each content of chromium (Cr) and aluminium (Al) is preferably 0.03 mass % or less. That is, the Fe—Si based alloy excludes an Fe—Si—Al alloy, an Fe—Si—Cr alloy, or the like in the present embodiment.

The Fe—Si based alloy contains phosphorus (P). In the present embodiment, a content of phosphorus (P) is 110 to 650 ppm, that is, 0.0110 to 0.0650 mass % provided that a total content of Fe and Si is 100 mass %. When a fired body is manufactured using the soft magnetic metal powder composed of such soft magnetic metal grains, it is possible to obtain a soft magnetic metal fired body capable of achieving both high resistivity and predetermined magnetic properties.

A content of phosphorus (P) is preferably 120 ppm or more, more preferably 150 ppm or more, provided that a total content of Fe and Si is 100 mass %. A content of phosphorus (P) is preferably 600 ppm or less, more preferably 550 ppm or less, provided that a total content of Fe and Si is 100 mass %.

When the content of phosphorus (P) in the soft magnetic metal grains is in the above range, it becomes easy to increase permeability while a high resistivity is maintained.

Incidentally, a content ratio of Si preferably has an upper limit of 10 mass % or less, more preferably 7.5 mass % or less, provided that a total content of Fe and Si is 100 mass %.

When the content ratio of Si is too large, the pressing property at the time of pressing using the soft magnetic metal powder deteriorates, and as a result, the density of the fired body tends to decrease. In addition, an oxidation state of alloy fired grains after a heat treatment cannot be maintained appropriately, and permeability particularly tends to decrease.

A content ratio of silicon preferably has a lower limit of 1.0 mass % or more, more preferably 2.0 mass % or more, and still more preferably 4.5 mass % or more in terms of Si, provided that a total content of Fe and Si is 100 mass %.

When the content ratio of Si is too small, the pressing property is improved, but an oxidation state of alloy fired grains after a heat treatment cannot be maintained appropriately, and permeability particularly tends to decrease.

The soft magnetic metal powder according to the present embodiment preferably has an average grain size (D50) of 2.0 μm or more, more preferably 2:5 μm or more. The soft magnetic metal powder according to the present embodiment preferably has an average grain size (D50) of 20.0 μm or less, more preferably 15.0 μm or less. When the soft magnetic metal powder has an average grain size in the above range, it becomes easy to increase permeability while a high resistivity is maintained. A laser diffraction scattering method is preferably employed as the measurement method of the average grain size. Incidentally, the soft magnetic metal grains constituting the soft magnetic metal powder have any shape.

2. Soft Magnetic Metal Fired Body

A soft magnetic metal fired body according to the present embodiment is configured in such a manner that a plurality of the soft magnetic metal fired grains is connected with each other. Specifically, a plurality of the soft magnetic metal fired grains is connected with each other via bonding due to reaction between elements contained in the soft magnetic metal grains in contact with each other and other elements (e.g. oxygen (O)). In the soft magnetic metal fired body according to the present embodiment, the soft magnetic metal grains derived from the soft magnetic metal powder are connected with each other by a heat treatment and turn into the soft magnetic metal fired grains, but grain growth of each grains hardly occurs.

The soft magnetic metal fired body according to the present embodiment is preferably manufactured by pressing and firing the above-mentioned soft magnetic metal powder.

The soft magnetic metal fired grains contained in the soft metal fired body are composed of an Fe—Si based alloy. In the present embodiment, similarly to the above-mentioned soft magnetic metal powder, a content of other elements including phosphorus mentioned below and excluding oxygen (O) is preferably 0.15 mass % or less at most provided that a total content of Fe and Si is 100 mass % in the Fe—Si based alloy. Each content of chromium (Cr) and aluminium (Al) is preferably 0.03 mass % or less. That is, the Fe—Si based alloy excludes an Fe—Si—Al alloy, an Fe—Si—Cr alloy, or the like in the present embodiment.

The Fe—Si based alloy contains phosphorus (P). A content of phosphorus (P) is 110 to 650 ppm, that is, 0.0110 to 0.0650 mass % provided that a total content of Fe and Si is 100 mass %.

When the soft magnetic metal fired body according to the present embodiment contains phosphorus in the above range, the electronic device can have a high resistivity that does not generate short circuit, for example $1.0\times10^5$ Ω·cm or more, and can demonstrate predetermined magnetic properties.

The reason why the soft magnetic metal fired body according to the present embodiment has the above-mentioned properties is unclear, but is conceived as below, for example. That is, it is conceivable that when the Fe—Si alloy is subjected to a heat treatment while containing a predetermined amount of phosphorus, the soft magnetic metal fired body constituting the soft magnetic metal fired body after the heat treatment has an appropriately controlled oxidation state. As a result, the soft magnetic metal fired body after the heat treatment exhibits a high resistivity and further can demonstrate predetermined magnetic properties. Thus, the soft magnetic metal fired body according to the present embodiment is preferable as a magnetic body that is directly in contact with the coil conductor.

A content of phosphorus (P) is preferably 120 ppm or more, more preferably 150 ppm or more, provided that a total content of Fe and Si is 100 mass %. A content of phosphorus (P) is preferably 600 ppm or less, more preferably 550 ppm or less, provided that a total content of Fe and Si is 100 mass %.

When the content of phosphorus (P) in the soft magnetic metal fired body is in the above range, it becomes easy to improve magnetic properties while a high resistivity is maintained.

Incidentally, a content ratio of Si preferably has an upper limit of 10 mass % or less, more preferably 7.5 mass % or less, provided that a total content of Fe and Si is 100 mass %.

When the content ratio of Si is too large, the alloy fired grains in the fired body has an inappropriate oxidation state, and permeability particularly tends to decrease.

A content of silicon preferably has a lower limit of 1.0 mass % or more, more preferably 2.0 mass % or more, and still more preferably 4.5 mass % or more, in terms of Si, provided that a total content of Fe and Si is 100 mass %.

When the content ratio of Si is too small, the alloy fired grains in the fired body has an inappropriate oxidation state, and resistivity tends to decrease.

In the present embodiment, the soft magnetic metal fired grains preferably has an average grain size (D50) of 2.0 μm or more, more preferably 2.5 μm or more. The soft magnetic metal fired grains preferably has an average grain size (D50) of 20.0 μm or less, more preferably 15.0 μm or less. That is, the average grain size (D50) of the soft magnetic metal powder and the average grain size (D50) of the soft magnetic metal fired grains approximately correspond to each other. This is because, as described above, the grain growth of the soft magnetic metal grains hardly occurs even if a heat treatment is performed.

When the soft magnetic metal fired grains have an average grain size in the above range, it becomes easy to increase permeability while a high resistivity is maintained. The average grain size is preferably measured as below.

First, a cross section of the fired body is observed by a SEM, an area of the fired grain is calculated by image analysis, and a value calculated as a diameter (equivalent circle diameter) of a circle corresponding to the area is determined as a grain size. Then, the grain size is calculated with respect to 100 or more fired grains, and a grain size to be D50 is determined as an average grain size. Incidentally, the soft magnetic metal fired grains have any shape.

3. Coil Type Electronic Device

A coil type electronic device according to the present embodiment is not limited as long as it includes the above-mentioned soft magnetic metal fired body as the magnetic body, and may be a composite electronic device containing an inductor part or so constituted by the magnetic body, for example. In the present embodiment, a multilayer inductor shown in FIG. 1 is illustrated as the multilayer coil type electronic device.

(3.1 Multilayer Inductor)

As shown in FIG. 1, a multilayer inductor 1 according to the present embodiment has an element 2 and terminal electrodes 3. The element 2 is configured in such a manner that a coil conductor 5 is embedded into a magnetic body layer 4 three-dimensionally and spirally. The magnetic body layer 4 is composed of the above-mentioned soft magnetic metal fired body. Both ends of the element 2 are provided with the terminal electrodes 3, and the terminal electrodes 3 are connected with the coil conductor 5 via leading electrodes 5*a* and 5*b*.

The element 2 has any shape, but normally has a rectangular parallelopiped shape. The element 2 has any size, and has an appropriate size based on usage.

The coil conductor 5 and the leading electrodes 5*a* and 5*b* are made of any electric conductor material, such as Ag, Cu, Au, Al, Pd, and Pd—Ag alloy.

In the multilayer inductor, when a voltage is applied via the terminal electrodes 3, the magnetic body existing inside the coil conductor 5 demonstrates a predetermined performance, and predetermined magnetic properties are obtained.

In the multilayer inductor according to the present embodiment, as mentioned above, the magnetic body and the coil conductor 5 are directly in contact with each other, but the soft magnetic material (the soft magnetic metal fired body according to the present embodiment) constituting the magnetic body has a high resistivity, and no short circuit thus occurs even if a voltage is applied. Thus, the multilayer inductor according to the present embodiment is established as the electronic device, and hence can demonstrate predetermined performances.

(3.1.1 Manufacturing Method of Multilayer Inductor)

Next, an example of manufacturing methods of the above multilayer inductor will be explained. First, a manufacturing method of the soft magnetic metal powder to be a raw material of the soft magnetic metal fired body constituting the magnetic body layer will be explained. In the present embodiment, the soft magnetic metal powder can be obtained using a similar method to known manufacturing methods of the soft magnetic metal powder. Specifically, the soft magnetic metal powder can be manufactured using a gas atomizing method, a water atomizing method, a rotating disk method, or the like. A water atomizing method of these methods is preferable from a viewpoint of easily obtaining a soft magnetic metal powder having predetermined magnetic properties.

In the water atomizing method, a molten raw material (molten metal) is supplied as a linear and continuous fluid via a nozzle provided in a bottom of a crucible, the supplied molten metal is made into droplets by being sprayed with a high-pressure water and is rapidly cooled, and a fine powder is obtained.

In the present embodiment, the soft magnetic metal powder according to the present embodiment can be obtained in such a manner that a raw material of iron (Fe) and a raw material of silicon (Si) are molten, and this molten substance to which phosphorus (P) is added is turned into a fine powder by the water atomizing method. When phosphorus (P) is contained as an inevitable impurity in a raw material of iron (Fe), for example, a molten material where a total content of phosphorus as the inevitable impurity and phosphorus to be added is adjusted to be in the above range may be turned into a fine powder by the water atomizing method. Instead, a molten material where the content of phosphorus in the soft magnetic metal powder is adjusted to be in the above range using a plurality of iron (Fe) having different contents of phosphorus may be turned into a fine powder by the water atomizing method.

Next, the multilayer inductor is manufactured using the soft magnetic metal powder obtained in this manner. The multilayer inductor is manufactured by any method, and a known method may be employed. A manufacturing method of the multilayer inductor using a sheet method will be explained below.

The obtained soft magnetic metal powder is turned into slurry with an additive, such as a solvent and a binder, to prepare a paste. A green sheet to be a magnetic body after being fired is formed using this paste. Then, silver (Ag) or so to be a coil conductor is formed with a predetermined pattern on the formed green sheet. Next, a plurality of the green sheets with the coil conductor pattern is laminated, and each coil conductor pattern is joined via through holes, whereby a green laminated body where a coil conductor is formed three-dimensionally and spirally is obtained.

When heat treatments (debinding step and firing step) are carried out against the obtained laminated body, binder is removed, the soft magnetic metal grains contained in the soft magnetic metal powder turn into the soft magnetic metal fired grains, and a laminated body as a fired body where the soft magnetic metal fired grains are connected with and fixed to each other (integrated) is obtained. The debinding step has any holding temperature (debinding temperature) as long as binder is dissolved and removed as gas, but preferably has a holding temperature of 300 to 450° C. in the present embodiment. The debinding step also has any holding time (debinding time), but preferably has a holding time of 0.5 to 2.0 hours in the present embodiment.

The firing step has any holding temperature (firing temperature) as long as the soft magnetic metal grains constituting the soft magnetic metal powder are connected with each other, but preferably has a holding temperature of 550 to 850° C. in the present embodiment. The firing step also has any holding time (firing time), but preferably has a holding time of 0.5 to 3.0 hours in the present embodiment.

The amount of phosphorus (P) contained in the soft magnetic metal fired grains after the heat treatments corresponds to the amount of phosphorus (P) contained in the soft magnetic metal grains before the heat treatments.

Next, the terminal electrodes 3 are formed on the laminated body (element 2) as a fired body, and the multilayer inductor 1 shown in FIG. 1 is thus obtained. The magnetic body 4 owned by the multilayer inductor 1 is constituted by the soft magnetic metal fired body according to the present embodiment, and no short circuit thus occurs even if in direct contact with the coil conductor 5. In addition, predetermined magnetic properties can be demonstrated.

Incidentally, the debinding step and the firing step preferably have an adjusted atmosphere in the present embodiment. Specifically, the debinding step and the firing step may be carried out in an oxidation atmosphere like the air, but are preferably carried out in an atmosphere whose oxidation power is weaker than that of the air atmosphere. It is thus possible to obtain a soft magnetic metal fired body whose fired body density, permeability (it), and the like are improved further than those of the soft magnetic metal fired body obtained by carrying out the debinding step and the firing step in the air atmosphere while a high resistivity of the soft magnetic metal fired body is maintained.

(3.2 Choke Coil)

In addition to the above-mentioned multilayer coil type electronic device, examples of the coil type electronic device according to the present embodiment include a coil type electronic device, such as a choke coil, where a magnetic core (magnetic body) with a predetermined shape is wound by a wire in a predetermined winding number.

Figure 2:
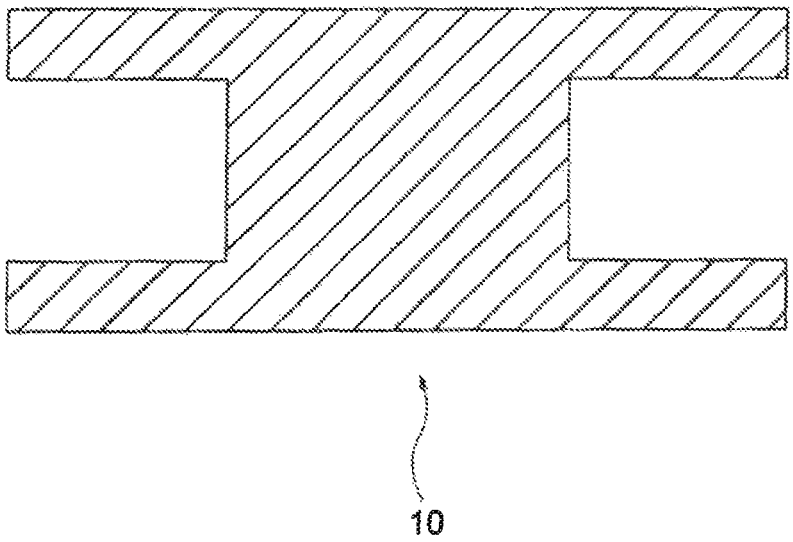
FIG. 2 is a schematic view of a cross section of a drum type magnetic core owned by a coil type electronic device according to an embodiment of the present invention.

In addition to the drum type magnetic core 10 shown in FIG. 2, examples of the shape of the magnetic core used for such a choke coil include FT type, ET type, EI type, UU type, EE type, EER type, UI type, toroidal type, pot type, and cut type.

When such a magnetic core is constituted by the above-mentioned soft magnetic metal fired body, a magnetic core having a high resistivity and being capable of demonstrating predetermined magnetic properties is obtained.

(3.2.1 Manufacturing Method of Choke Coil)

Next, a manufacturing method of the above choke coil will be explained. The magnetic core owned by the choke coil is manufactured by any method, and a known method may be employed. First, a soft magnetic metal powder to be a raw material of a soft magnetic metal fired body constituting the magnetic core as a magnetic body is prepared. The soft magnetic metal powder to be prepared may be a powder prepared in the same manner as (3.1.1).

Next, the soft magnetic metal powder and the binder as a bonding agent are mixed to obtain a mixture. If necessary, the mixture may be turned into a granulated powder. Then, the mixture or the granulated powder is pressed into the shape of the magnetic body (magnetic core) to be manufactured, and a green compact is obtained. The obtained green compact is subjected to heat treatments (debinding step and firing step), and a magnetic core is obtained. The obtained magnetic core is wound by a wire in a predetermined number, and a choke coil is obtained. In this choke coil, the magnetic core is constituted by the soft magnetic fired body according to the present embodiment, and no short circuit thus occurs even if no insulation treatment is performed against the surface of the magnetic core. In addition, predetermined magnetic properties can be further demonstrated.

Incidentally, the holding time and the atmosphere in the debinding step and the firing step are similar to those of (3.1.1).

4. Effects of Present Embodiment

In the present embodiment explained in (1) to (3) mentioned above, a predetermined amount of phosphorus (P) is contained in the Fe—Si based alloy constituting the soft magnetic metal grains contained in the soft magnetic metal powder. An element (soft magnetic metal fired body) where the soft magnetic metal fired grains are connected with each other is obtained by performing a heat treatment (firing) against the green compact obtained by pressing such a powder. This soft magnetic metal fired body has a high resistivity of $1.0\times10^5$ Ω·cm or more, for example, and can further demonstrate predetermined magnetic properties.

It is conceivable that the soft magnetic metal grains contain phosphorus (P) in the above-mentioned range before the heat treatment, and both improvement in insulation property due to oxidation of the soft magnetic metal grains and reduction in regions for magnetic properties associated with the oxidation of the grains are thus favorably controlled during the heat treatment of the green compact.

Even if the multilayer coil type electronic device is configured in such a manner that a coil conductor is embedded into an element and a magnetic body and the coil conductor are directly in contact with each other, no short circuit occurs when the magnetic body is constituted by the soft magnetic metal fired body according to the present embodiment with such a high resistivity. Thus, the soft magnetic metal fired body according to the present embodiment is greatly favorable as a magnetic body of multilayer coil type electronic devices.

In the coil type electronic device having the magnetic core wound by the wire as the coil conductor, when the magnetic core is constituted by the soft magnetic metal fired body according to the present embodiment, no short circuit occurs even if no insulation treatment is performed against the surface of the magnetic core.

Furthermore, the soft magnetic metal fired body according to the present embodiment and the coil type electronic device using it can demonstrate predetermined magnetic properties, such as permeability, inductance, Q value, and DC superposition properties, while a high permeability is maintained.

Furthermore, the present embodiment discovers that the debinding step and the firing step preferably have an atmosphere whose oxidation power is weaker than that of the air atmosphere when heat treatments are performed against the green compact containing binder and the soft magnetic metal powder containing phosphorus (P). In addition to the above-mentioned effects, the following effect is consequently obtained: permeability can be improved while a high resistivity is maintained, compared to the fired body obtained by carrying out the debinding step and the firing step in the air atmosphere. In particular, this effect becomes remarkably large when phosphorus (P) is contained within the above-mentioned range.

Furthermore, when controlling the average grain size of the soft magnetic metal powder and the ratio of Si in the Fe—Si based alloy, it is possible to obtain a magnetic body achieving both permeability and magnetic properties while a high permeability is maintained.

The embodiment of the present invention is accordingly described, but the present invention is not limited to the above embodiment, and may be changed to various embodiments within the scope of the present invention.

EXAMPLES

Hereinafter, the invention will be explained in more detail using examples, but the present invention is not limited to the examples.

Experimental Example 1

First, ingots, chunks (blocks), or shots (grains) of a simple substance of Fe and a simple substance of Si were prepared as raw materials. Next, the raw materials were mixed and housed in a crucible arranged in a water atomizing apparatus. Then, in an inert atmosphere, the crucible was heated to 1600° C. or more by high-frequency induction using a work coil arranged outside the crucible, and the ingots, chunks, or shots in the crucible were molten and mixed to obtain a molten metal. Incidentally, the content of phosphorus was adjusted by controlling the content of phosphorus in the raw material of the simple substance of Fe when melting and mixing the raw materials of a soft magnetic metal powder.

Next, the molten metal supplied from a nozzle arranged in the crucible so that a linear and continuous fluid was formed was collided with a high-pressure (50 MPa) water flow to be droplets, rapidly cooled at the same time, dehydrated, dried, and classified, whereby a soft magnetic metal powder (average grain size (D50): 5.0 μm) composed of Fe—Si based alloy grains was manufactured.

The obtained soft magnetic metal powder was subjected to composition analysis by ICP analysis method, and was consequently confirmed to have the compositions and the contents of phosphorus shown in Table 1.

An acrylic resin as a binder was added to the obtained soft magnetic metal powder to prepare a granulated powder. This granulated powder was pressed at a pressure of 6 ton/cm$^2$ to be a drum shape having an outer diameter of 13 mm, an inner diameter of 6 mm, and a height of 2.7 to 3.3 mm. Next, the green compact was held at 400° C. and debindered in the air atmosphere, and the green compact after the debinding was fired under a condition of 600° C.—1 hour in the air atmosphere, whereby a soft magnetic metal fired body having a toroidal shape was obtained. The obtained fired body was measured in terms of fired body density, permeability (μ), and resistivity (ρ) by the following manner.

The fired body density was calculated from size and weight of the obtained fired body. The fired body density is preferably higher. The permeability was measured at f=2 MHz by coaxial technique using an RF impedance material analyzer (manufactured by Agilent Technologies: 4991 A). The permeability is preferably higher. The resistivity ρ was calculated from volume of the fire body in a manner that In—Ga electrodes were applied to both surfaces of the fire body, and a DC resistance was measured by an ultra high resistance meter (manufactured by ADVANTEST: R8340). A resistivity of $1.0\times10^5$ Ω·cm or more was considered to be good. The results are shown in Table 1. Incidentally, the obtained fired bodies were cracked and subjected to ICP analysis, and all of the fired bodies had a composition and a content of phosphorus approximately corresponding to those of the soft magnetic metal powder. The average grain size (D50) of the soft magnetic metal fired grains in the fired body was calculated by the above-mentioned method and corresponded to the average grain size (D50) of the soft magnetic metal powder.

TABLE 1

| Sample | Soft magnetic metal powder Composition (mass %) | | (ppm) | (μm) | Debinding condition | Firing conditions (° C.) Firing | | Soft magnetic metal fired body (g/cm³) | Permeability | (Ω · m) Resistivity |
|---|---|---|---|---|---|---|---|---|---|---|
| No. | Fe | Si | P | D50 | Atmosphere | temperature | Atmosphere | Density | (μ) | (ρ) |
| Comp. Ex. 1-1 | 94.0 | 6.0 | 80 | 5.0 | Air | 600 | Air | 5.36 | 16.7 | $2 \times 10^5$ |
| Ex. 2-1 | 94.0 | 6.0 | 110 | 5.0 | Air | 600 | Air | 5.37 | 20.5 | $2 \times 10^7$ |
| Ex. 3-1 | 94.0 | 6.0 | 120 | 5.0 | Air | 600 | Air | 5.37 | 21.0 | $5 \times 10^7$ |
| Ex. 4-1 | 94.0 | 6.0 | 150 | 5.0 | Air | 600 | Air | 5.38 | 23.0 | $7 \times 10^8$ |
| Ex. 5-1 | 94.0 | 6.0 | 350 | 5.0 | Air | 600 | Air | 5.40 | 25.0 | $7 \times 10^9$ |
| Ex. 6-1 | 94.0 | 6.0 | 550 | 5.0 | Air | 600 | Air | 5.41 | 22.0 | $6 \times 10^9$ |
| Ex. 7-1 | 94.0 | 6.0 | 650 | 5.0 | Air | 600 | Air | 5.38 | 20.0 | $6 \times 10^9$ |
| Comp. Ex. 8-1 | 94.0 | 6.0 | 700 | 5.0 | Air | 600 | Air | 5.34 | 16.5 | $8 \times 10^9$ |

It was confirmed from Table 1 that all of the samples had a good resistivity, but when the content of phosphorus (P) was out of the above-mentioned range, permeability decreased, and resistivity and magnetic properties could not be obtained at the same time.

On the other hand, it was confirmed that when the content of phosphorus (P) was within the above-mentioned range, permeability improved, and both resistivity and predetermined properties could be obtained, compared to when the content of phosphorus (P) was out of the above-mentioned range.

Experimental Example 2

Samples were manufactured in the same manner as Experimental Example 1, and properties of fired bodies were evaluated in the same manner as Experimental Example 1, except that the debinding step had an inert atmosphere ($N_2$ gas), and the firing step had an inert atmosphere or a reducing atmosphere (mixed gas of $N_2$=99.5% and $H_2$=0.5%). The results are shown in Table 2.

TABLE 2

| Sample | Soft magnetic metal powder Composition (mass %) | | (ppm) | (μm) | Debinding condition | Firing conditions (° C.) Firing | | Soft magnetic metal fired body (g/cm³) | Permeability | (%) | (Ω · m) Resistivity |
|---|---|---|---|---|---|---|---|---|---|---|---|
| No. | Fe | Si | P | D50 | Atmosphere | temperature | Atmosphere | Density | (μ) | Δμ/μ | (ρ) |
| Comp. Ex. 1-1 | 94.0 | 6.0 | 80 | 5.0 | Air | 600 | Air | 5.36 | 16.7 | | $2 \times 10^6$ |
| Comp. Ex. 1-2 | 94.0 | 6.0 | 80 | 5.0 | $N_2$ | 600 | $N_2$ | 5.38 | 19.1 | 14.3 | $2 \times 10^4$ |
| Comp. Ex. 1-3 | 94.0 | 6.0 | 80 | 5.0 | $N_2$ | 600 | $N_2$ = 99.5%, $H_2$ = 0.5% | 5.42 | 22.0 | 31.7 | $7 \times 10^2$ |
| Ex. 2-1 | 94.0 | 6.0 | 110 | 5.0 | Air | 600 | Air | 5.37 | 20.5 | | $2 \times 10^7$ |
| Ex. 2-2 | 94.0 | 6.0 | 110 | 5.0 | $N_2$ | 600 | $N_2$ | 5.39 | 23.0 | 10.9 | $5 \times 10^6$ |
| Ex. 2-3 | 94.0 | 6.0 | 110 | 5.0 | $N_2$ | 600 | $N_2$ = 99.5%, $H_2$ = 0.5% | 5.44 | 25.5 | 24.4 | $1 \times 10^5$ |
| Ex. 3-1 | 94.0 | 6.0 | 120 | 5.0 | Air | 600 | Air | 5.37 | 21.0 | | $5 \times 10^7$ |
| Ex. 3-2 | 94.0 | 6.0 | 120 | 5.0 | $N_2$ | 600 | $N_2$ | 5.39 | 24.2 | 15.2 | $5 \times 10^6$ |
| Ex. 3-3 | 94.0 | 6.0 | 120 | 5.0 | $N_2$ | 600 | $N_2$ = 99.5%, $H_2$ = 0.5% | 5.45 | 27.3 | 30.0 | $2 \times 10^5$ |
| Ex. 4-1 | 94.0 | 6.0 | 150 | 5.0 | Air | 600 | Air | 5.38 | 23.0 | | $7 \times 10^8$ |
| Ex. 4-2 | 94.0 | 6.0 | 150 | 5.0 | $N_2$ | 600 | $N_2$ | 5.40 | 26.5 | 15.2 | $5 \times 10^7$ |
| Ex. 4-3 | 94.0 | 6.0 | 150 | 5.0 | $N_2$ | 600 | $N_2$ = 99.5%, $H_2$ = 0.5% | 5.47 | 31.0 | 34.8 | $3 \times 10^6$ |
| Ex. 5-1 | 94.0 | 6.0 | 350 | 5.0 | Air | 600 | Air | 5.40 | 25.0 | | $7 \times 10^9$ |
| Ex. 5-2 | 94.0 | 6.0 | 350 | 5.0 | $N_2$ | 600 | $N_2$ | 5.46 | 29.0 | 16.0 | $2 \times 10^7$ |
| Ex. 5-3 | 94.0 | 6.0 | 350 | 5.0 | $N_2$ | 600 | $N_2$ = 99.5%, $H_2$ = 0.5% | 5.52 | 33.5 | 34.0 | $5 \times 10^5$ |
| Ex. 6-1 | 94.0 | 6.0 | 550 | 5.0 | Air | 600 | Air | 5.41 | 22.0 | | $6 \times 10^9$ |
| Ex. 6-2 | 94.0 | 6.0 | 550 | 5.0 | $N_2$ | 600 | $N_2$ | 5.43 | 25.5 | 15.9 | $5 \times 10^7$ |
| Ex. 6-3 | 94.0 | 6.0 | 550 | 5.0 | $N_2$ | 600 | $N_2$ = 99.5%, $H_2$ = 0.5% | 5.50 | 31.5 | 30.2 | $4 \times 10^5$ |
| Ex. 7-1 | 94.0 | 6.0 | 650 | 5.0 | Air | 600 | Air | 5.38 | 20.0 | | $6 \times 10^9$ |
| Ex. 7-2 | 94.0 | 6.0 | 650 | 5.0 | $N_2$ | 600 | $N_2$ | 5.39 | 22.0 | 10.0 | $7 \times 10^7$ |
| Ex. 7-3 | 94.0 | 6.0 | 650 | 5.0 | $N_2$ | 600 | $N_2$ = 99.5%, $H_2$ = 0.5% | 5.41 | 24.0 | 20.0 | $7 \times 10^5$ |
| Ex. 8-1 | 94.0 | 6.0 | 700 | 5.0 | Air | 600 | Air | 5.34 | 16.5 | | $8 \times 10^9$ |
| Comp. Ex. 8-2 | 94.0 | 6.0 | 700 | 5.0 | $N_2$ | 600 | $N_2$ | 5.35 | 17.1 | 3.6 | $1 \times 10^8$ |
| Comp. Ex. 8-3 | 94.0 | 6.0 | 700 | 5.0 | $N_2$ | 600 | $N_2$ = 99.5%, $H_2$ = 0.5% | 5.36 | 17.7 | 7.3 | $1 \times 10^8$ |

It was confirmed from Table 2 that when the debinding step and the firing step had an atmosphere whose oxidation power was weaker than that of the air atmosphere, permeability was greatly improved while a high resistivity was maintained.

Experimental Example 3

Samples were manufactured in the same manner as Experimental Example 1, and properties of fired bodies were evaluated in the same manner as Experimental Example 1, except that the soft magnetic metal powder had a changed average grain size as shown in Table 3. The results are shown in Table 3. Samples were manufactured in the same manner as Experimental Example 1, and properties of fired bodies were evaluated in the same manner as Experimental Example 1, except that the soft magnetic metal grains had a changed ratio of Si in the soft magnetic metal grains as shown in Table 4. The results are shown in Table 4.

TABLE 3

| Sample | Soft magnetic metal powder Composition (mass %) | | (ppm) | (μm) | Debinding condition | Firing conditions (° C.) Firing | | Soft magnetic metal fired body (g/cm³) | Permeability | (%) | (Ω · m) Resistivity |
|---|---|---|---|---|---|---|---|---|---|---|---|
| No. | Fe | Si | P | D50 | Atmosphere | temperature | Atmosphere | Density | (μ) | Δμ/μ | (ρ) |
| Ex. 9-1 | 94.0 | 6.0 | 350 | 2.5 | Air | 600 | Air | 5.30 | 20.0 | | $2 \times 10^5$ |
| Ex. 9-2 | 94.0 | 6.0 | 350 | 2.5 | $N_2$ | 600 | $N_2$ | 5.46 | 23.0 | 15.0 | $7 \times 10^6$ |
| Ex. 9-3 | 94.0 | 6.0 | 350 | 2.5 | $N_2$ | 600 | $N_2$ = 99.5%, $H_2$ = 0.5% | 5.52 | 26.0 | 30.0 | $2 \times 10^5$ |
| Ex. 5-1 | 94.0 | 6.0 | 350 | 5.0 | Air | 600 | Air | 5.40 | 25.0 | | $7 \times 10^8$ |
| Ex. 5-2 | 94.0 | 6.0 | 350 | 5.0 | $N_2$ | 600 | $N_2$ | 5.46 | 29.0 | 16.0 | $2 \times 10^7$ |
| Ex. 5-3 | 94.0 | 6.0 | 350 | 5.0 | $N_2$ | 600 | $N_2$ = 99.5%, $H_2$ = 0.5% | 5.52 | 33.5 | 34.0 | $5 \times 10^5$ |
| Ex. 10-1 | 94.0 | 6.0 | 300 | 7.5 | Air | 600 | Air | 5.47 | 30.0 | | $8 \times 10^9$ |
| Ex. 10-2 | 94.0 | 6.0 | 300 | 7.5 | $N_2$ | 600 | $N_2$ | 5.53 | 34.8 | 16.0 | $5 \times 10^7$ |
| Ex. 10-3 | 94.0 | 6.0 | 300 | 7.5 | $N_2$ | 600 | $N_2$ = 99.5%, $H_2$ = 0.5% | 5.58 | 40.0 | 33.3 | $3 \times 10^5$ |
| Ex. 11-1 | 94.0 | 6.0 | 350 | 7.5 | Air | 600 | Air | 5.46 | 29.5 | | $9 \times 10^9$ |
| Ex. 11-2 | 94.0 | 6.0 | 350 | 7.5 | $N_2$ | 600 | $N_2$ | 5.52 | 34.0 | 15.3 | $6 \times 10^7$ |
| Ex. 11-3 | 94.0 | 6.0 | 350 | 7.5 | $N_2$ | 600 | $N_2$ = 99.5%, $H_2$ = 0.5% | 5.57 | 39.0 | 32.2 | $4 \times 10^5$ |
| Ex. 12-1 | 94.0 | 6.0 | 230 | 10.5 | Air | 600 | Air | 5.57 | 33.5 | | $8 \times 10^8$ |
| Ex. 12-2 | 94.0 | 6.0 | 230 | 10.5 | $N_2$ | 600 | $N_2$ | 5.63 | 38.6 | 15.2 | $2 \times 10^7$ |
| Ex. 12-3 | 94.0 | 6.0 | 230 | 10.5 | $N_2$ | 600 | $N_2$ = 99.5%, $H_2$ = 0.5% | 5.68 | 45.0 | 34.3 | $2 \times 10^5$ |
| Ex. 13-1 | 94.0 | 6.0 | 350 | 10.5 | Air | 600 | Air | 5.56 | 32.5 | | $9 \times 10^9$ |
| Ex. 13-2 | 94.0 | 6.0 | 350 | 10.5 | $N_2$ | 600 | $N_2$ | 5.61 | 37.5 | 15.4 | $3 \times 10^7$ |
| Ex. 13-3 | 94.0 | 6.0 | 350 | 10.5 | $N_2$ | 600 | $N_2$ = 99.5%, $H_2$ = 0.5% | 5.66 | 43.0 | 32.3 | $3 \times 10^5$ |
| Ex. 14-1 | 94.0 | 6.0 | 650 | 10.5 | Air | 600 | Air | 5.53 | 27.5 | | $7 \times 10^9$ |
| Ex. 14-2 | 94.0 | 6.0 | 650 | 10.5 | $N_2$ | 600 | $N_2$ | 5.55 | 31.0 | 12.7 | $5 \times 10^7$ |
| Ex. 14-3 | 94.0 | 6.0 | 650 | 10.5 | $N_2$ | 600 | $N_2$ = 99.5%, $H_2$ = 0.5% | 5.57 | 34.0 | 23.6 | $4 \times 10^5$ |
| Ex. 15-1 | 94.0 | 6.0 | 350 | 15.0 | Air | 600 | Air | 5.61 | 35.0 | | $2 \times 10^9$ |
| Ex. 15-2 | 94.0 | 6.0 | 350 | 15.0 | $N_2$ | 600 | $N_2$ | 5.65 | 40.0 | 14.3 | $1 \times 10^7$ |
| Ex. 15-3 | 94.0 | 6.0 | 350 | 15.0 | $N_2$ | 600 | $N_2$ = 99.5%, $H_2$ = 0.5% | 5.70 | 47.0 | 34.3 | $1 \times 10^5$ |

TABLE 4

| Sample | Soft magnetic metal powder Composition (mass %) | | (ppm) | (μm) | Debinding condition | Firing conditions (° C.) Firing | | Soft magnetic metal fired body (g/cm³) | Permeability | (%) | (Ω · m) Resistivity |
|---|---|---|---|---|---|---|---|---|---|---|---|
| No. | Fe | Si | P | D50 | Atmosphere | temperature | Atmosphere | Density | (μ) | Δμ/μ | (ρ) |
| Ex. 16-1 | 92.5 | 7.5 | 400 | 5.0 | Air | 600 | Air | 5.25 | 20.0 | | $2 \times 10^9$ |
| Ex. 16-2 | 92.5 | 7.5 | 400 | 5.0 | $N_2$ | 600 | $N_2$ | 5.32 | 23.0 | 13.9 | $7 \times 10^7$ |
| Ex. 16-3 | 92.5 | 7.5 | 400 | 5.0 | $N_2$ | 600 | $N_2$ = 99.5%, $H_2$ = 0.5% | 5.36 | 25.6 | 26.7 | $9 \times 10^5$ |
| Ex. 17-1 | 93.0 | 7.0 | 400 | 5.0 | Air | 600 | Air | 5.35 | 23.0 | | $5 \times 10^9$ |
| Ex. 17-2 | 93.0 | 7.0 | 400 | 5.0 | $N_2$ | 600 | $N_2$ | 5.40 | 26.5 | 15.2 | $5 \times 10^7$ |
| Ex. 17-3 | 93.0 | 7.0 | 400 | 5.0 | $N_2$ | 600 | $N_2$ = 99.5%, $H_2$ = 0.5% | 5.47 | 30.5 | 32.6 | $7 \times 10^5$ |
| Ex. 18-1 | 94.0 | 6.0 | 400 | 5.0 | Air | 600 | Air | 5.39 | 24.8 | | $8 \times 10^9$ |
| Ex. 18-2 | 94.0 | 6.0 | 400 | 5.0 | $N_2$ | 600 | $N_2$ | 5.45 | 28.7 | 15.7 | $4 \times 10^7$ |
| Ex. 18-3 | 94.0 | 6.0 | 400 | 5.0 | $N_2$ | 600 | $N_2$ = 99.5%, $H_2$ = 0.5% | 5.51 | 33.2 | 33.9 | $5 \times 10^5$ |
| Ex. 19-1 | 95.0 | 5.0 | 400 | 5.0 | Air | 600 | Air | 5.43 | 25.2 | | $3 \times 10^9$ |
| Ex. 19-2 | 95.0 | 5.0 | 400 | 5.0 | $N_2$ | 600 | $N_2$ | 5.49 | 29.7 | 16.5 | $1 \times 10^7$ |

TABLE 4-continued

| Sample | Soft magnetic metal powder Composition (mass %) | | (ppm) | (μm) | Debinding condition | Firing conditions (° C.) Firing | | Soft magnetic metal fired body (g/cm³) | Permeability | (%) | (Ω · m) Resistivity |
|---|---|---|---|---|---|---|---|---|---|---|---|
| No. | Fe | Si | P | D50 | Atmosphere | temperature | Atmosphere | Density | (μ) | Δμ/μ | (ρ) |
| Ex. 19-3 | 95.0 | 5.0 | 400 | 5.0 | $N_2$ | 600 | $N_2$ = 99.5%, $H_2$ = 0.5% | 5.53 | 33.0 | 31.0 | $2 \times 10^5$ |
| Ex. 20-1 | 94.5 | 4.5 | 400 | 5.0 | Air | 600 | Air | 5.47 | 24.0 | | $7 \times 10^7$ |
| Ex. 20-2 | 94.5 | 4.5 | 400 | 5.0 | $N_2$ | 600 | $N_2$ | 5.53 | 27.5 | 14.6 | $8 \times 10^6$ |
| Ex. 20-3 | 94.5 | 4.5 | 400 | 5.0 | $N_2$ | 600 | $N_2$ = 99.5%, $H_2$ = 0.5% | 5.63 | 30.5 | 27.1 | $1 \times 10^5$ |

It was confirmed from Table 3 and Table 4 that when controlling the average grain size of the soft magnetic metal powder and the ratio of Si in the soft magnetic metal grains, permeability could be greatly improved while a high resistivity was maintained.

Experimental Example 4

The soft magnetic metal powder manufactured in Experimental Example 1 was turned into slurry with additives, such as solvent and binder, to prepare a paste and form a green sheet. The green sheet was provided with an Ag conductor (coil conductor) with a predetermined pattern and laminated to manufacture a green multilayer inductor having a shape of 2.0 mm×1.6 mm×1.0 mm.

Next, the green multilayer inductor was debindered at 400° C. in the air atmosphere or an inert atmosphere, and the multilayer inductor after the debinding was then fired in a condition of 600° C.—1 hour in the air atmosphere, an inert atmosphere, or a reducing atmosphere, whereby a multilayer inductor having a soft magnetic metal fired body as a magnetic body layer was obtained. The obtained multilayer inductor was provided with a terminal electrode, and L and Q properties were measured by the following manner. L and Q were measured at f=2 MHz using a LCR meter (manufactured by HEWLETT PACKARD: 4285 A). L and Q are preferably higher. The results are shown in Table 5.

TABLE 5

| Sample | Soft magnetic metal powder Composition (mass %) | | (ppm) | (μm) | Debinding condition | Firing conditions (° C.) Firing | | Multilayer inductor (μH) | | (%) | (Ratio) Number of |
|---|---|---|---|---|---|---|---|---|---|---|---|
| No. | Fe | Si | P | D50 | Atmosphere | temperature | Atmosphere | L | 0 | ΔL/L | short circuits |
| Comp. Ex. 1-1 | 94.0 | 6.0 | 80 | 5.0 | Air | 600 | Air | 0.30 | 25.0 | | 0/30 |
| Comp. Ex. 1-2 | 94.0 | 6.0 | 80 | 5.0 | $N_2$ | 600 | $N_2$ | 0.34 | 28.0 | 13.3 | 15/30 |
| Comp. Ex. 1-3 | 94.0 | 6.0 | 80 | 5.0 | $N_2$ | 600 | $N_2$ = 99.5%, $H_2$ = 0.5% | — | — | — | 30/30 |
| Ex. 2-1 | 94.0 | 6.0 | 110 | 5.0 | Air | 600 | Air | 0.49 | 30.0 | | 0/30 |
| Ex. 2-2 | 94.0 | 6.0 | 110 | 5.0 | $N_2$ | 600 | $N_2$ | 0.55 | 32.0 | 12.2 | 0/30 |
| Ex. 2-3 | 94.0 | 6.0 | 110 | 5.0 | $N_2$ | 600 | $N_2$ = 99.5%, $H_2$ = 0.5% | 0.62 | 34.0 | 26.5 | 0/30 |
| Ex. 3-1 | 94.0 | 6.0 | 120 | 5.0 | Air | 600 | Air | 0.51 | 32.0 | | 0/30 |
| Ex. 3-2 | 94.0 | 6.0 | 120 | 5.0 | $N_2$ | 600 | $N_2$ | 0.59 | 35.0 | 15.7 | 0/30 |
| Ex. 3-3 | 94.0 | 6.0 | 120 | 5.0 | $N_2$ | 600 | $N_2$ = 99.5%, $H_2$ = 0.5% | 0.67 | 36.0 | 31.3 | 0/30 |
| Ex. 5-1 | 94.0 | 6.0 | 350 | 5.0 | Air | 600 | Air | 0.60 | 37.0 | | 0/30 |
| Ex. 5-2 | 94.0 | 6.0 | 350 | 5.0 | $N_2$ | 600 | $N_2$ | 0.71 | 39.0 | 18.3 | 0/30 |
| Ex. 5-3 | 94.0 | 6.0 | 350 | 5.0 | $N_2$ | 600 | $N_2$ = 99.5%, $H_2$ = 0.5% | 0.80 | 41.0 | 33.3 | 0/30 |
| Ex. 7-1 | 94.0 | 6.0 | 650 | 5.0 | Air | 600 | Air | 0.50 | 34.0 | | 0/30 |
| Ex. 7-2 | 94.0 | 6.0 | 650 | 5.0 | $N_2$ | 600 | $N_2$ | 0.56 | 36.0 | 12.0 | 0/30 |
| Ex. 7-3 | 94.0 | 6.0 | 650 | 5.0 | $N_2$ | 600 | $N_2$ = 99.5%, $H_2$ = 0.5% | 0.62 | 35.0 | 24.0 | 0/30 |
| Comp. Ex. 8-1 | 94.0 | 6.0 | 700 | 5.0 | Air | 600 | Air | 0.32 | 27.0 | | 0/30 |
| Comp. Ex. 8-2 | 94.0 | 6.0 | 700 | 5.0 | $N_2$ | 600 | $N_2$ | 0.34 | 30.0 | 6.2 | 0/30 |
| Comp. Ex. 8-3 | 94.0 | 6.0 | 700 | 5.0 | $N_2$ | 600 | $N_2$ = 99.5%, $H_2$ = 0.5% | 0.35 | 30.0 | 9.4 | 0/30 |

It was confirmed from Table 5 that even when the soft magnetic metal fired body was applied to the magnetic body layer of the multilayer inductor, no short circuit occurred and predetermined magnetic properties (L and Q) were secured as long as the content of phosphorus (P) was in the above-mentioned range as with Table 1. It was also confirmed that when the debinding step and the firing step had an atmosphere whose oxidation power was weaker than that of the air atmosphere, magnetic properties (L and Q) could be improved while a high resistivity was maintained.

NUMERICAL REFERENCES

1 . . . multilayer inductor
2 . . . element
4 . . . magnetic body layer
5 . . . coil conductor
3 . . . terminal electrode
10 . . . magnetic core

The invention claimed is:

1. A soft magnetic metal powder comprising a plurality of soft magnetic metal grains composed of an Fe—Si based alloy, wherein:

a content of Si is 4.5 to 7.5 mass % provided that a total content of Fe and Si is 100 mass %;

a content of elements other than Fe and Si excluding oxygen in the Fe—Si based alloy is 0.15 mass % or less provided that the total content of Fe and Si is 100 mass %;

a content of P in the Fe—Si based alloy is 110 to 650 ppm provided that the total content of Fe and Si is 100 mass %;

a content of Al in the Fe—Si based alloy is 0.03 mass % or less provided that the total content of Fe and Si is 100 mass %; and a content of Cr in the Fe—Si based alloy is 0.03 mass % or less provided that the total content of Fe and Si is 100 mass %.

2. The soft magnetic metal powder according to claim 1 having an average grain size (D50) of 2.0 to 20.0 μm.

3. A soft magnetic metal fired body comprising soft magnetic metal fired grains composed of an Fe—Si based alloy, wherein:

a content of Si is 4.5 to 7.5 mass % provided that a total content of Fe and Si is 100 mass %;

a content of elements other than Fe and Si excluding oxygen in the Fe—Si based alloy is 0.15 mass % or less provided that the total content of Fe and Si is 100 mass %;

a content of P in the Fe—Si based alloy is 110 to 650 ppm provided that the total content of Fe and Si is 100 mass %;

a content of Al in the Fe—Si based alloy is 0.03 mass % or less provided that the total content of Fe and Si is 100 mass %; and a content of Cr in the Fe—Si based alloy is 0.03 mass % or less provided that the total content of Fe and Si is 100 mass %.

4. The soft magnetic metal fired body according to claim 3, wherein the soft magnetic metal fired grains have an average grain size (D50) of 2.0 to 20.0 μm.

5. A multilayer coil type electronic device comprising an element in which a coil conductor and a magnetic body are laminated, wherein the magnetic body is composed of the soft magnetic metal fired body according to claim 4.

6. A coil type electronic device comprising a magnetic core, wherein the magnetic core is composed of the soft magnetic metal fired body according to claim 4.

7. A multilayer coil type electronic device comprising an element in which a coil conductor and a magnetic body are laminated, wherein the magnetic body is composed of the soft magnetic metal fired body according to claim 3.

8. The multilayer coil type electronic device according to claim 7, wherein the magnetic body is directly in contact with the coil conductor.

9. A coil type electronic device comprising a magnetic core, wherein the magnetic core is composed of the soft magnetic metal fired body according to claim 3.

10. The coil type electronic device according to claim 9, wherein a surface of the magnetic core has not been treated with insulation.

* * * * *